US008783804B2

(12) United States Patent
Panchawagh et al.

(10) Patent No.: US 8,783,804 B2
(45) **Date of Patent: *Jul. 22, 2014**

(54) FUNCTIONAL LIQUID DEPOSITION USING CONTINUOUS LIQUID DISPENSER

(75) Inventors: Hrishikesh V. Panchawagh, Rochester, NY (US); Yonglin Xie, Pittsford, NY (US); Carolyn R. Ellinger, Rochester, NY (US); Michael A. Marcus, Honeoye Falls, NY (US); Thomas W. Palone, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 106 days.

This patent is subject to a terminal disclaimer.

(21) Appl. No.: 13/432,020

(22) Filed: Mar. 28, 2012

(65) Prior Publication Data

US 2013/0257991 A1 Oct. 3, 2013

(51) Int. Cl.
*B41J 29/38* (2006.01)
*B41J 2/04* (2006.01)
*B41J 2/05* (2006.01)

(52) U.S. Cl.
USPC ..... 347/9; 347/54; 347/65

(58) Field of Classification Search
None
See application file for complete search history.

(56) References Cited

U.S. PATENT DOCUMENTS

| | | | |
|---|---|---|---|
| 6,431,671 | B2 | 8/2002 | Matsumoto |
| 6,464,341 | B1 | 10/2002 | Furlani et al. |
| 6,517,181 | B2 | 2/2003 | Yamamoto |
| 6,588,884 | B1 | 7/2003 | Furlani et al. |
| 6,598,960 | B1 | 7/2003 | Cabal et al. |
| 6,721,020 | B1 | 4/2004 | Delametter et al. |
| 6,817,702 | B2 | 11/2004 | Delametter et al. |
| 6,869,169 | B2 | 3/2005 | Cabal et al. |
| 7,073,890 | B2 | 7/2006 | Cabal et al. |
| 7,188,931 | B2 | 3/2007 | Cabal et al. |
| 7,914,109 | B2 | 3/2011 | Xie et al. |
| 7,914,121 | B2 | 3/2011 | Xie et al. |
| 8,033,646 | B2 | 10/2011 | Xie et al. |
| 8,033,647 | B2 | 10/2011 | Xie et al. |
| 8,118,408 | B2 | 2/2012 | Xie et al. |
| 2002/0051029 | A1 | 5/2002 | Yamamoto |
| 2010/0238232 | A1 * | 9/2010 | Clarke et al. ..... 347/21 |
| 2010/0328403 | A1 | 12/2010 | Xie et al. |

OTHER PUBLICATIONS

Meyer, Robert F., et al., "Universal Dripping and Jetting in a Transverse Shear Flow", Physical Review Letters 102, 194501, May 15, 2009.

* cited by examiner

*Primary Examiner* — Stephen Meier
*Assistant Examiner* — Renee I Wilson
(74) *Attorney, Agent, or Firm* — William R. Zimmerli

(57) ABSTRACT

A method of dispensing liquid includes providing a carrier liquid under pressure using a first liquid supply that flows from the first liquid supply through a first liquid supply channel through a liquid dispensing channel through a liquid return channel and back to the first liquid supply continuously during a drop dispensing operation. A functional liquid is provided to the liquid dispensing channel through a second liquid supply channel using a second liquid supply. A drop formation device is selectively actuated to form a discrete drop of the functional liquid in the carrier liquid flowing through the liquid dispensing channel. The functional liquid is immiscible in the carrier liquid. The drop ejection device is selectively actuated to divert the discrete drop of the functional liquid and a portion of the carrier liquid flowing through the liquid dispensing channel toward an outlet opening of the liquid dispensing channel.

5 Claims, 6 Drawing Sheets

FUNCTIONAL LIQUID DEPOSITION USING CONTINUOUS LIQUID DISPENSER

CROSS REFERENCE TO RELATED APPLICATIONS

Reference is made to commonly-assigned, U.S. patent application Ser. No. 13/432,017, entitled "FUNCTIONAL LIQUID DEPOSITION USING CONTINUOUS LIQUID", filed concurrently herewith.

FIELD OF THE INVENTION

This invention relates generally to the field of liquid dispensers, and in particular to liquid drop dispensers that create a drop of liquid by diverting a quantity of the liquid from a continuous flow of the liquid.

BACKGROUND OF THE INVENTION

There is an increasing demand for patterned deposition of materials on receivers in traditional image and document printing and upcoming manufacturing applications. These deposition techniques can be broadly classified in non-contact printing methods such as ink jet printing and contact printing methods such as screen printing, flexography, offset lithography, or slot coating.

Ink jet printing has become recognized as a prominent contender in the digitally controlled, electronic printing arena because, e.g., of its non-impact, low-noise characteristics, its use of plain paper and its avoidance of toner transfer and fixing that is required in electrophotography based printing methods. Traditionally, inkjet printing is accomplished by one of two technologies referred to as "drop-on-demand" and "continuous" inkjet printing. In both, liquid, such as ink, is fed through channels formed in a printhead. Each channel includes a nozzle from which droplets are selectively extruded and deposited upon a recording surface.

The first technology, "drop-on-demand" (DOD) ink jet printing, provides ink drops that impact upon a recording surface using a pressurization actuator, for example, a thermal, piezoelectric, or electrostatic actuator. One commonly practiced drop-on-demand technology uses thermal actuation to eject ink drops from a nozzle. A heater, located at or near the nozzle, heats the ink sufficiently to boil, forming a vapor bubble that creates enough internal pressure to eject an ink drop. This form of inkjet is commonly termed "thermal ink jet (TIJ)."

The second technology commonly referred to as "continuous" ink jet (CU) printing, uses a pressurized ink source to produce a continuous liquid jet stream of ink by forcing ink, under pressure, through a nozzle. The stream of ink is perturbed using a drop formation mechanism such that the liquid jet breaks up into drops of ink in a predictable manner. One continuous printing technology uses thermal stimulation of the liquid jet to form drops that eventually become print drops and non-print drops. Printing occurs by selectively deflecting one of the print drops and the non-print drops and catching the non-print drops. Various approaches for selectively deflecting drops have been developed including electrostatic deflection, air deflection, and thermal deflection.

Printing systems that combine aspects of drop on demand printing and continuous printing are also known. These systems offer increased drop ejection frequency when compared to drop on demand printing systems without the complexity of continuous printing systems.

Many other applications are emerging in which it is desired to dispense liquids, other than inks, that need to be finely metered and deposited with precision. It would be advantageous to dispense these liquids using devices similar to inkjet printheads. Often, however, these liquids have one or more characteristics, for example, a high viscosity or a high particle loading, which makes it unpractical or extremely difficult for these liquids to be deposited using devices similar to inkjet printheads. Other examples include inks are sensitive to heat making it incompatible with a bubble actuator and inks including solvents that easily dry and adhere to the nozzle structure causing a failure of the printhead. As such, there is an ongoing effort to find devices and techniques that are suitable for dispensing these liquids.

SUMMARY OF THE INVENTION

According to one aspect of the present invention, a method of dispensing liquid includes providing a liquid dispenser. The liquid dispenser includes a first liquid supply channel; a liquid dispensing channel including an outlet opening; a liquid return channel; and a second liquid supply channel. The liquid dispensing channel is in fluid communication with the first liquid supply channel. The liquid return channel is in fluid communication with the liquid dispensing channel. The second liquid supply channel is in fluid communication with the liquid dispensing channel. A first liquid supply is provided. A second liquid supply is provided. A drop formation device is associated with an interface of the second liquid supply channel and the liquid dispensing channel. A drop ejection device is provided. A carrier liquid is provided under pressure using the first liquid supply and flows from the first liquid supply through the first liquid supply channel through the liquid dispensing channel through the liquid return channel and back to the first liquid supply continuously during a drop dispensing operation. A functional liquid is provided to the liquid dispensing channel through the second liquid supply channel using the second liquid supply. The drop formation device is selectively actuated to form a discrete drop of the functional liquid in the carrier liquid flowing through the liquid dispensing channel. The functional liquid is immiscible in the carrier liquid. The drop ejection device is selectively actuated to divert the discrete drop of the functional liquid and a portion of the carrier liquid flowing through the liquid dispensing channel toward the outlet opening of the liquid dispensing channel.

BRIEF DESCRIPTION OF THE DRAWINGS

In the detailed description of the example embodiment of the invention presented below, reference is made to the accompanying drawings, in which.

DETAILED DESCRIPTION OF THE INVENTION

Figure 1:
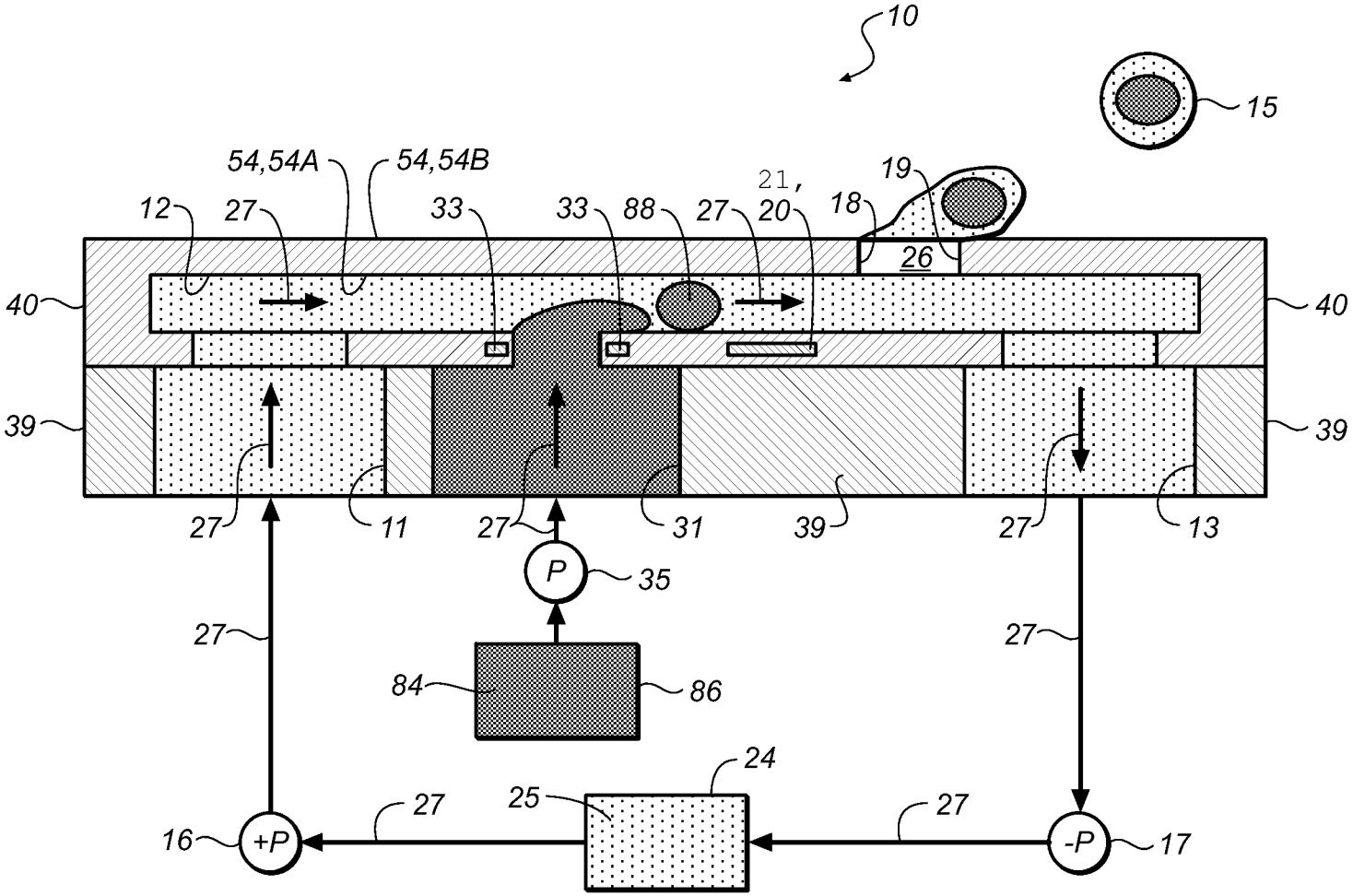
FIG. 1 is a schematic cross sectional view of an example embodiment of a liquid dispenser made in accordance with the present invention.

The present description will be directed in particular to elements forming part of, or cooperating more directly with, apparatus in accordance with the present invention. It is to be understood that elements not specifically shown or described may take various forms well known to those skilled in the art. In the following description and drawings, identical reference numerals have been used, where possible, to designate identical elements.

The example embodiments of the present invention are illustrated schematically and not to scale for the sake of clarity. One of the ordinary skills in the art will be able to readily determine the specific size and interconnections of the elements of the example embodiments of the present invention.

As described herein, the example embodiments of the present invention provide a liquid dispenser, often referred to as a printhead, which is particularly useful in digitally controlled inkjet printing devices in which drops of ink are ejected from a printhead toward a print medium. However, many other applications are emerging which use liquid dispensers, similar to inkjet printheads, to emit liquids, other than inks, that need to be finely metered and deposited with high spatial precision. As such, as described herein, the terms "liquid" and "ink" are used interchangeably and refer to any material, not just inkjet inks, which can be ejected by the example embodiments of the liquid dispenser described below.

In addition to inkjet printing applications in which the fluid typically includes a colorant for printing an image, the liquid dispenser of the present invention is also advantageously used in ejecting other types of fluidic materials. Such materials include functional materials for fabricating devices (including conductors, resistors, insulators, magnetic materials, and the like), structural materials for forming three-dimensional structures, biological materials, and various chemicals. The liquid dispenser of the present invention provides sufficient force to eject fluids having a higher viscosity than typical inkjet inks, and does not impart excessive heat into the fluids that could damage the fluids or change their properties undesirably.

Figure 2:
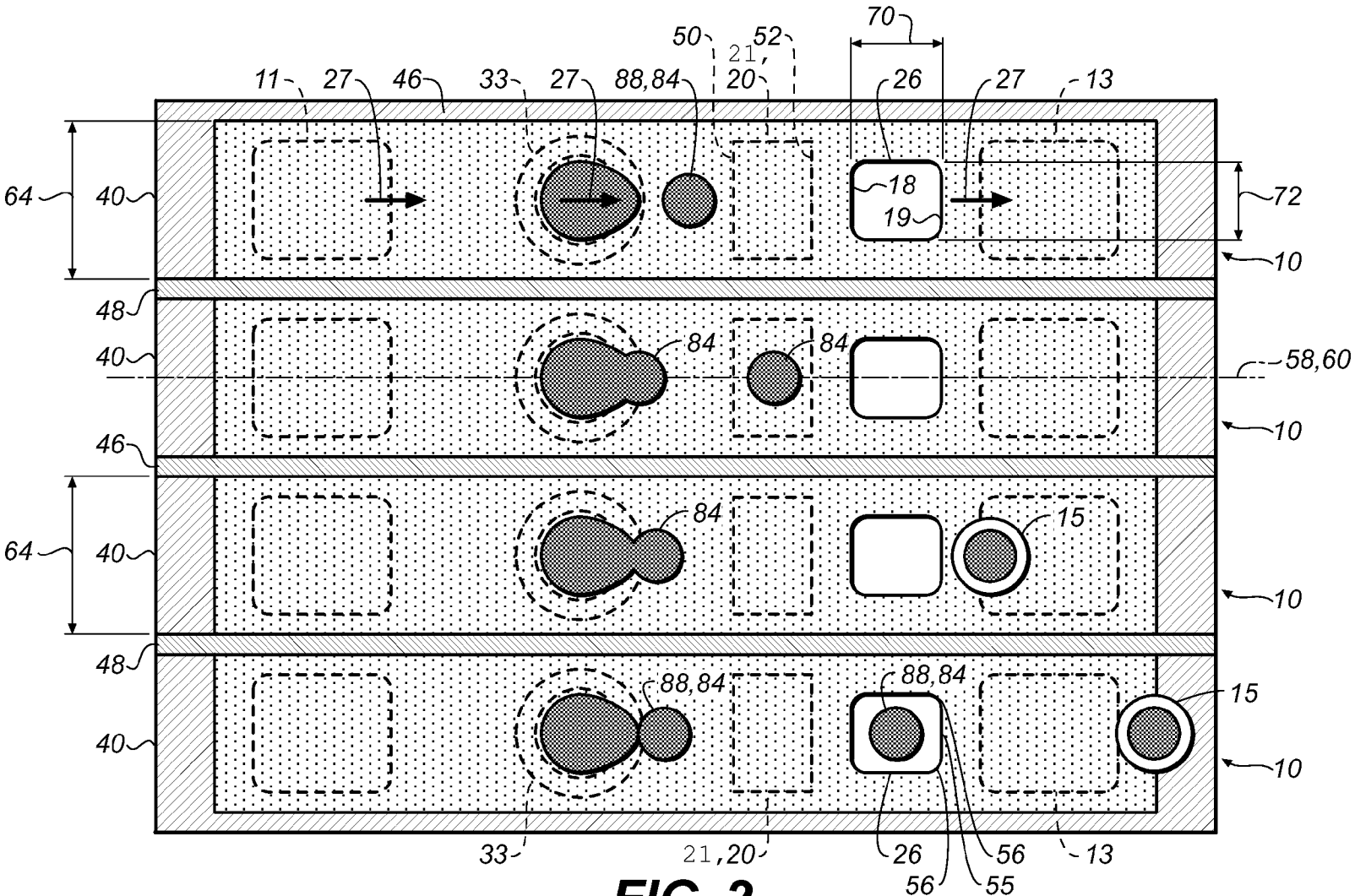
FIG. 2 is a schematic top view of the example embodiment of the liquid dispenser shown in FIG. 1.

Referring to FIGS. 1 and 2, generally described, a liquid dispenser made in accordance with the present invention includes a first liquid supply channel, a liquid dispensing channel, and a liquid return channel in fluid communication with each other. The liquid dispensing channel includes an outlet opening. A second liquid supply channel is in fluid communication with the liquid dispensing channel. A first liquid supply provides a carrier liquid that flows from the first liquid supply through the first liquid supply channel through the liquid dispensing channel through the liquid return channel and back to the first liquid supply continuously during a drop dispensing operation. A second liquid supply provides a functional liquid to the liquid dispensing channel through the second liquid supply channel. A drop formation device, associated with an interface of the second liquid supply channel and the liquid dispensing channel, is selectively actuated or controlled to form a discrete drop of the functional liquid in the carrier liquid flowing through the liquid dispensing channel. The functional liquid is immiscible in the carrier liquid. A drop ejection device is selectively actuated or controlled to divert the discrete drop of the functional liquid and a portion of the carrier liquid flowing through the liquid dispensing channel toward the outlet opening of the liquid dispensing channel.

Referring to FIG. 1, an example embodiment of a liquid dispenser 10 made in accordance with the present invention is shown. Liquid dispenser 10 includes a liquid supply channel 11 that is in fluid communication with a liquid return channel 13 through a liquid dispensing channel 12. Liquid dispensing channel 12 includes a drop ejection device 20. The drop ejection device 20 includes one or more drop ejection transducers 21, which can be controlled digitally in response in input print data. A liquid 25, often referred to as a carrier liquid, flows through liquid supply channel 11, liquid dispensing channel 12, and liquid return channel 13 through a liquid dispensing channel 12 continuously during operation.

Liquid dispensing channel 12 includes an outlet opening 26, defined by an upstream edge 18 and a downstream edge 19, which opens directly to atmosphere. Outlet opening 26 is different and distinct when compared to conventional nozzles because the area of the outlet opening 26 does not determine the size of the ejected drops. Instead, the actuation of drop ejection transducer 20 determines the size (for example, the volume) of the ejected drop. Typically, the size of drops created is proportional to the amount of liquid displaced by the actuation of drop ejection device 20. In the liquid dispenser 10 of the present invention, the region of liquid dispensing channel 12 located upstream and proximate to the upstream edge 18 of outlet opening 26 is typically of a size that is similar to the size of a conventional nozzle.

Advantageously, liquid ejected by liquid dispenser 10 of the present invention does not need to travel through a conventional nozzle, which typically has a smaller area, in order to reach atmosphere. This helps to reduce the likelihood of the outlet opening 26 becoming contaminated or clogged by particle contaminants. Using a larger outlet opening 26 (as compared to a conventional nozzle) also reduces latency problems at least partially caused by evaporation in the area of a conventional nozzle during periods when drops are not being ejected. The larger outlet opening 26 also reduces the likelihood of satellite drop formation during drop ejection because drops are produced with shorter tail lengths.

Drop ejection device 20, associated with liquid dispensing channel 12, for example, positioned on or in substrate 39, is selectively actuated to divert a portion of liquid in liquid dispensing channel 12 toward (and ultimately through) outlet opening 26 of liquid dispensing channel 12 in order to form and eject a drop 15. The primary motive energy for the creation of drops 15 (and ejection of drops 15), however, comes from the momentum of the traveling liquid moving though the liquid dispensing channel 12 as described in one or more of U.S. Pat. No. 8,033,647; U.S. Pat. No. 8,033,646; U.S. Pat. No. 7,914,121; U.S. Pat. No. 7,914,109; or U.S. Pat. No. 8,118,408; the disclosure of each of these patents is incorporated by reference herein in its entirety.

A second liquid supply channel 31 in liquid communication with liquid dispensing channel 12 provides a second liquid 84 to liquid dispensing channel 12. Liquid supply channel 11, often referred to as a first liquid supply channel, and second liquid supply channel 31 are physically distinct from each other which allows liquid 25, often referred to as a first liquid, and second liquid 84 to be different types of liquid having different fluid characteristics when compared to each other. For example, second liquid 84 having a high viscosity (making it difficult to jet) can include properties that increase its conductive ability while first liquid 25 having a low viscosity (making it easier to jet) can include properties that facilitate drop formation while at least partially shielding the second liquid 84 from the effects of the drop ejection device.

A second liquid supply 86 is in liquid communication with liquid dispensing channel 12 through second liquid supply channel 31. Second liquid supply 86 provides second liquid 84 to liquid dispensing channel 12. During operation, second liquid 84, is periodically pressurized, typically, above atmospheric pressure, by a second regulated pressure source 35, for example, a pump, to form a bulge of second liquid 84 in liquid dispensing channel 12. A drop formation device 33 associated with the interface of the second liquid supply channel 31 and liquid dispensing channel 12 is actuated to cause a drop 88 of second liquid 84 to form in the first liquid 25 that is flowing through liquid dispensing channel 12. The drop formation device 33 includes one or more drop formation transducers 34 which can be controlled digitally in response in input print data. Drop 15 includes the discrete drop 88 of liquid 84 and some of liquid 25. Accordingly, drop 15 is often referred to as a composite drop 15.

Typically, liquid supply channel 11, liquid dispensing channel 12, liquid return channel 13, and second liquid supply channel 31 are at least partially defined by portions of substrate 39. These portions of substrate 39 can also be referred to as a wall or walls of one or more of liquid supply channel 11, liquid dispensing channel 12, liquid return channel 13, and second liquid supply channel 31. A structure 40, including one or more material layers on substrate 39, defines outlet opening 26 and also partially defines liquid supply channel 11, liquid dispensing channel 12, and liquid return channel 13. As shown in FIG. 1, liquid supply channel 11, liquid return channel 13, and second liquid supply channel 31 are perpendicular to liquid dispensing channel 12.

A liquid supply 24 is connected in fluid communication to liquid dispenser 10. Liquid supply 24 provides liquid 25 to liquid dispensing channel 12. During operation, liquid 25, pressurized by a regulated pressure supply source 16, for example, a pump, flows (represented by arrows 27) from liquid supply 24 through liquid supply channel 11, through liquid dispensing channel 12, through liquid return channel 13, and back to liquid supply 24 in a continuous manner. When a composite drop 15 is desired, drop formation device 33 is actuated to create a drop 88 of liquid 84 in flow of liquid 25 and the drop ejection device 20 is actuated to cause a portion of the liquid 25 and drop 88 of liquid 84 in liquid dispensing channel 12 to be ejected toward and through outlet opening 26. When this is done, the timing of actuation of the drop formation transducers 34 of the drop formation device 33 and the timing of actuation of the drop ejection transducers 21 of the drop ejection device 20 are synchronized using a controller (not shown).

Typically, regulated pressure supply source 16 is positioned in fluid communication between liquid supply 24 and liquid supply channel 11 and provides a positive pressure that is above atmospheric pressure. The level of liquid pressurization varies depending on the specific application contemplated provided, however, that the liquid 25 flowing through liquid dispensing channel 12 is traveling at a velocity that is sufficient to cause the liquid 25 to travel past outlet opening 26 without unintentionally spilling over or through the outlet opening 26.

Optionally, a regulated vacuum supply source 17, for example, a pump, can be included in the liquid delivery system of liquid dispenser 10 in order to better control liquid flow through liquid dispenser 10. Typically, regulated vacuum supply source 17 is positioned in fluid communication between liquid return channel 13 and liquid supply 24 and provides a vacuum (negative) pressure that is below atmospheric pressure.

Liquid dispenser 10 is typically formed from a semiconductor material (for example, silicon) using known semiconductor fabrication techniques (for example, CMOS circuit fabrication techniques, micro-electro mechanical structure (MEMS) fabrication techniques, or a combination of both). Alternatively, liquid dispenser 10 can be formed using other conventional materials and fabrication techniques known in the art.

Focusing now on the drop formation device 33, the pressures on the carrier liquid supply channel 11 and functional liquid supply channel 31 are adjusted to create a meniscus 90 between liquid 1 and liquid 2 having a radius of curvature r that balances the pressure P1 at the carrier liquid side of the meniscus and pressure P2 at the functional liquid side of the meniscus with an interfacial surface tension (γ) between the two phases as $$P2 - P1 = \frac{2\gamma}{r}.$$

By adjusting P1, P2 or γ, it is possible to disturb the force balance at the meniscus 90 between liquid 1 and liquid 2 and change the radius of curvature r. This is achieved with the drop formation device 33. When liquid 84 protrudes sufficiently in the carrier liquid 27 flowing through the liquid dispensing channel 12, the shear forces are sufficient overcome the surface tension forces to break a functional liquid drop from the nozzle which then flows in the carrier liquid. Thus, by controlling the drop formation device 33, one can digitally generate drops 88 of functional liquid 84 on-demand based on input data.

Choices for drop formation transducers 34 are wide ranging and include those to control interfacial surface tension, fluid viscosities, fluid pressures or flow rates, local shear rate, phase change in carrier fluid (bubble), or geometry modulation. The drop formation device 33 is used to control not only the pattern of the functional liquid drops but also the size of the drops 88 formed in liquid dispensing channel 12.

A model of continuous dripping mode drop formation of functional liquid in a cross shear flow of carrier liquid has been described in Universal Dripping and Jetting in a Transverse Shear Flow, Robert F. Meyer and John C. Crocker, Phys. Rev. Lett. 102, 194501 (2009), (hereinafter "Meyer and Crocker"). The model equates the drag force on the liquid meniscus of the functional liquid caused by the flow of the carrier liquid to the surface tension force between interfaces of two liquids that opposes formation. As the shape of the meniscus determines the drag force, the size of the liquid supply channel 31 at its interface with the liquid dispensing channel 12, $D_0$, the pressures P1 and P2 or a steady carrier fluid and functional liquid flow rates Q1 and Q2 are important in determining the drop formation.

The frequency of drop formation depends on the flow rate Q1. The viscosity of the liquid 84 is important in determining if a drop 88 of liquid 84 is created or flows in the form of a sheet. Meyer and Crocker also show that the size of the drop 88 of liquid 84 is determined by $D_0$. This is because the walls in the liquid dispensing channel are sufficiently away from the liquid meniscus and do not affect the fluid dynamics of drop formation.

Referring to FIG. 2, a liquid dispenser array structure including a plurality of liquid dispensers 10 is shown. The plurality of liquid dispensers 10 are formed, for example, integrally formed through a series of material layering and processing steps, on a common substrate 39 using the fabrication techniques described above to create a monolithic liquid dispenser structure. When compared to other types of liquid dispensers, monolithic liquid dispenser configurations help to improve the alignment of each outlet opening relative to other outlet openings which improves drop deposition accuracy. Monolithic liquid dispenser configurations also help to reduce spacing in between adjacent outlet openings which increases the dots per inch (dpi) capability of the device.

The liquid dispenser of the present invention only ejects composite drops 15 when desired. However, liquid 25 is continuously flowing past outlet opening 26 during a drop dispensing operation. When compared to conventional continuous liquid drop ejection systems, the need for a gutter and the need for a drop deflection mechanism which directs some of the created drops to the gutter while directing other drops to a print receiving media has been eliminated. The liquid dispenser of the present invention uses a liquid supply that supplies liquid under pressure to the liquid dispensing channel 12. The supplied liquid velocity, typically, created by providing the liquid 25 at pressure, serves as the primary motive energy for the ejected drops, so that most of the drop momentum comes from the momentum of the traveling liquid moving though the liquid dispensing channel 12 instead of a drop ejector positioned in or proximate a liquid chamber or nozzle. In this manner, the liquid dispenser of the present invention differs from a conventional drop on demand or flow through drop on demand printing system.

Referring back to FIGS. 1 and 2, a wall 46 and a wall 48 define a width 64, as viewed perpendicular to the direction of liquid flow 27, of liquid dispensing channel 12 and a width, as viewed perpendicular to the direction of liquid flow 27, of liquid dispensing channel 12. A length 70, as viewed along the direction of liquid flow 27, and a width 72, as viewed perpendicular to the direction of liquid flow 27, of outlet opening 26 relative to the length and width of liquid dispensing channel 12 are also shown. The width 72 of outlet opening 26 is less than the width 64 of the liquid dispensing channel 12.

Drop ejection device 20 is positioned in liquid dispensing channel such that an upstream edge 50 of drop ejection device 20 is located in liquid dispensing channel 12 upstream relative to the upstream edge 18 of outlet opening 26. The downstream edge 52 of drop ejection device 20 is located upstream from the downstream edge 19 of outlet opening 26 and upstream from the upstream edge 18 of the outlet opening 26. The positioning or location of the drop ejection device 20 can be adjusted depending on the specific application contemplated. For example, drop ejection device 20 can be placed in the liquid dispensing channel 12, the first liquid supply channel 11, the second liquid supply channel 31, or in a combination of these locations (either in addition or as an alternative to positioning the drop ejection device 20 in the liquid dispensing channel 12).

The positioning or location of the drop formation device 33 can be adjusted depending on the specific application contemplated. For example, drop formation device 33 can be placed in the liquid dispensing channel 12 between first liquid supply channel 11 and second liquid supply channel 31, at the interface of second liquid supply channel 31 and liquid dispensing channel 12, in the liquid dispensing channel 12 between the outlet 27 of second liquid supply channel 31, or within second liquid supply channel 31.

Structure 40, that defines outlet opening 26, includes a surface 54. Surface 54 can be either an interior surface 54A or an exterior surface 54B. The downstream edge 19, as viewed in the direction of liquid flow 27 through liquid dispensing channel 12, of outlet opening 26 is perpendicular relative to the surface 54 (either or both of surface 54A or surface 54B) of structure 40 of liquid dispensing channel 12.

Downstream edge 19 of outlet opening 26 can include other features. For example, a central portion 55 of the downstream edge 19 of outlet opening 26 is straight when viewed from a direction perpendicular to surface 54 of structure 40. When central portion 55 of the downstream edge 19 is straight, the corners 56 of downstream edge 19 can be rounded to provide mechanical stability and reduce stress induced cracks in structure 40.

Outlet opening 26 includes a centerline 58 along the direction of the liquid flow 27 through liquid dispensing channel 12 as viewed from a direction perpendicular to surface 54 of structure 40 of liquid dispensing channel 12. Liquid dispensing channel 12 includes a centerline 60 along the direction of the liquid flow 27 through liquid dispensing channel 12 as viewed from a direction perpendicular to surface 54 of structure 40 of liquid dispensing channel 12. As shown in FIG. 2, liquid dispensing channel 12 and outlet opening 26 share this centerline 58, 60. The overall shape of the outlet opening 26 is symmetric relative to the centerline 58 of the outlet opening 26. The overall shape of the liquid dispensing channel 12 is symmetric relative to the centerline 60 of the liquid dispensing channel 12. It is believed that optimal drop ejection performance is achieved when the overall shape of the liquid dispensing channel 12 and the overall shape of the outlet opening 26 are symmetric relative to a shared centerline 58, 60.

Figure 4:
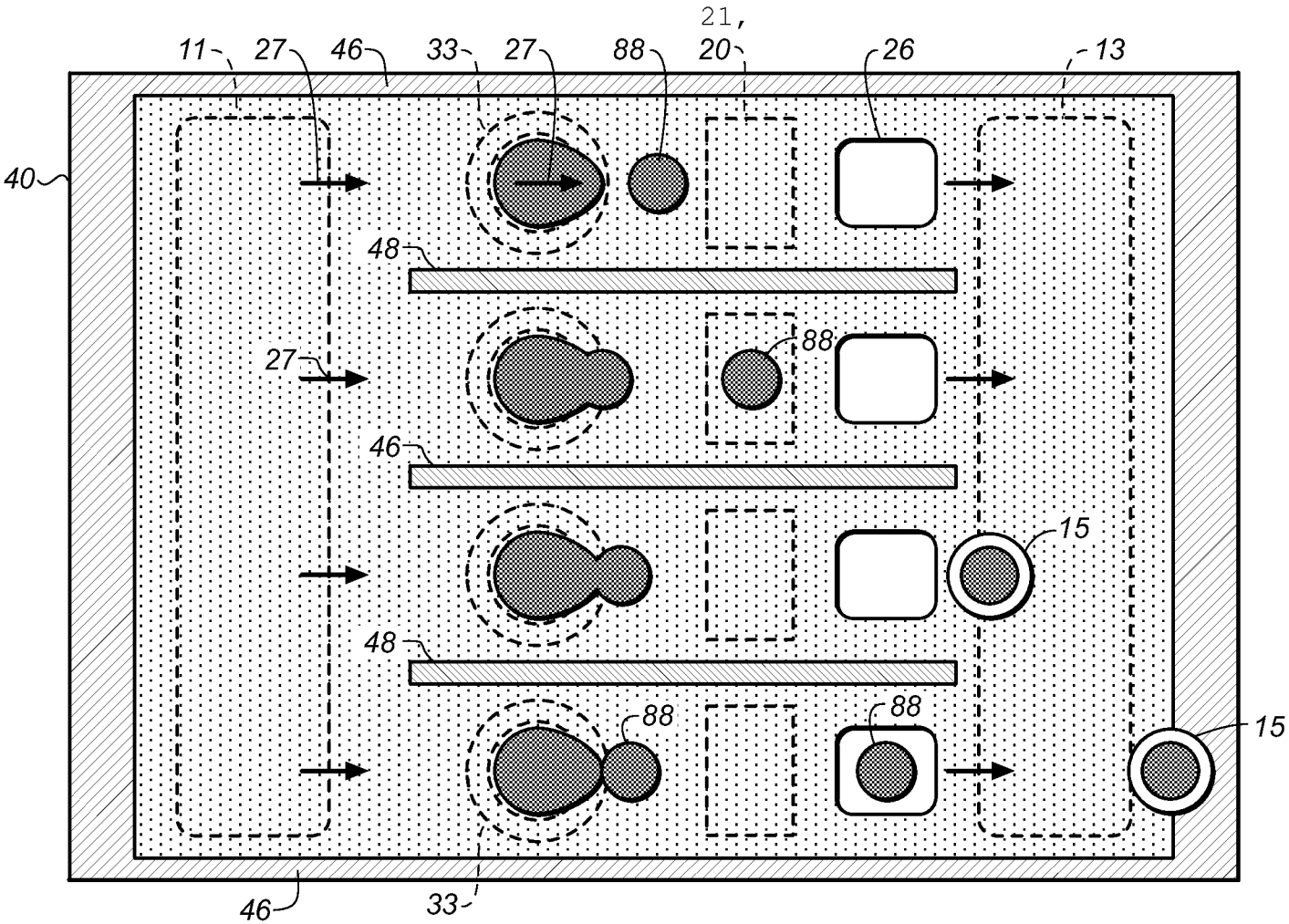
FIG. 4 is a schematic top view of another example embodiment of a liquid dispenser made in accordance with the present invention.

In FIG. 2, walls 46 and 48 extend to separate each of the plurality of liquid supply channels 11, the plurality of liquid dispensing channels 12, the plurality of the liquid supply channels 31, the plurality of drop formation devices 33, the plurality of drop ejection devices 20, the plurality of outlet openings 26, and the plurality of liquid return channels 13 formation an array of the structures 40. Referring to FIG. 4, in other example embodiments, the walls separate only the plurality of the liquid supply channels 31, the plurality of drop formation devices 33, the plurality of drop ejection devices 20, the plurality of outlet openings 26 without separating the plurality of liquid supply channels 11 or the plurality of liquid return channels 13. As walls 46, 48 only separate the liquid dispensing portion of the liquid dispensers 10, liquid supply channel 11 is common to the plurality of liquid dispensers 10. Liquid return channel 13 is also common to the plurality of liquid dispensers 10 because walls 46, 48 only separate the liquid dispensing portion of the liquid dispensers 10.

Figure 5:
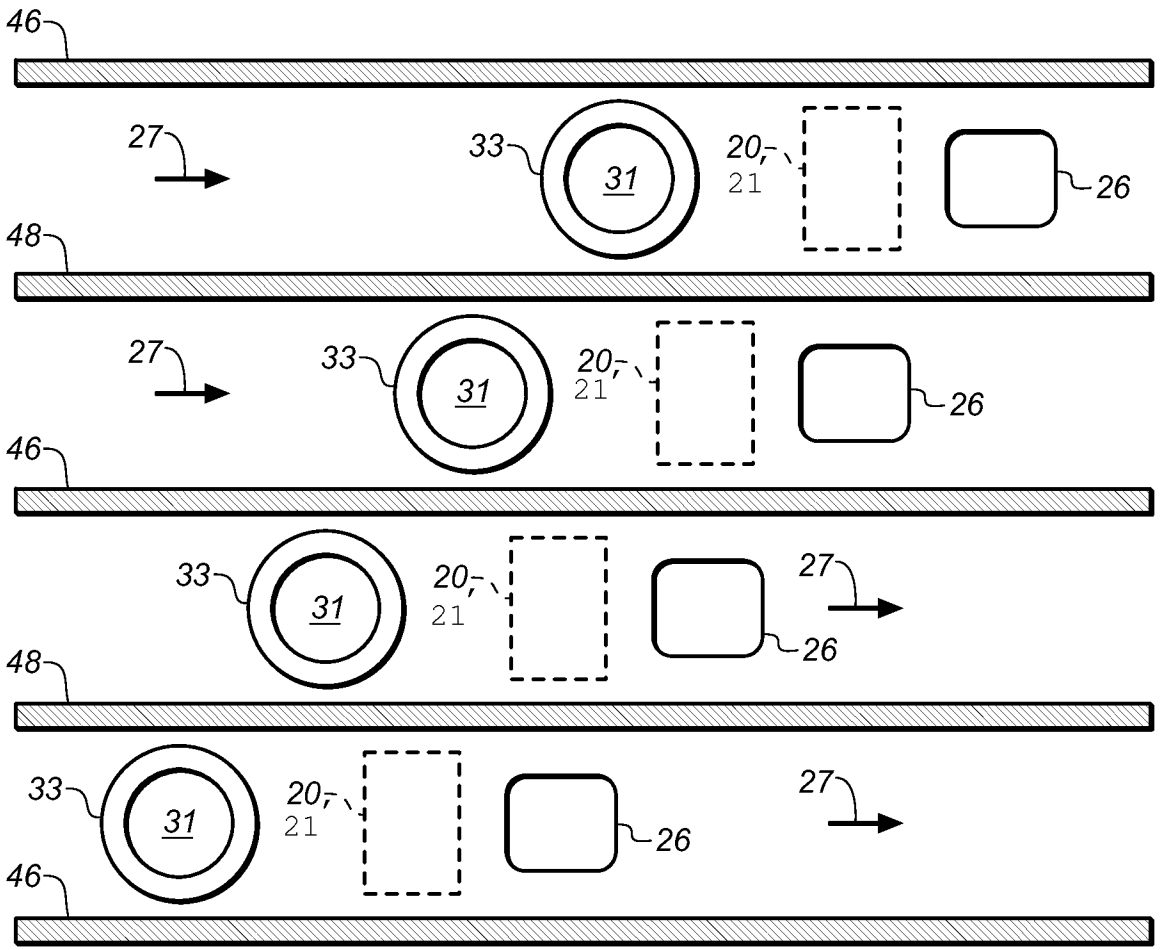
FIG. 5 is a schematic top view of another example embodiment of a liquid dispenser made in accordance with the present invention.
Figure 6:
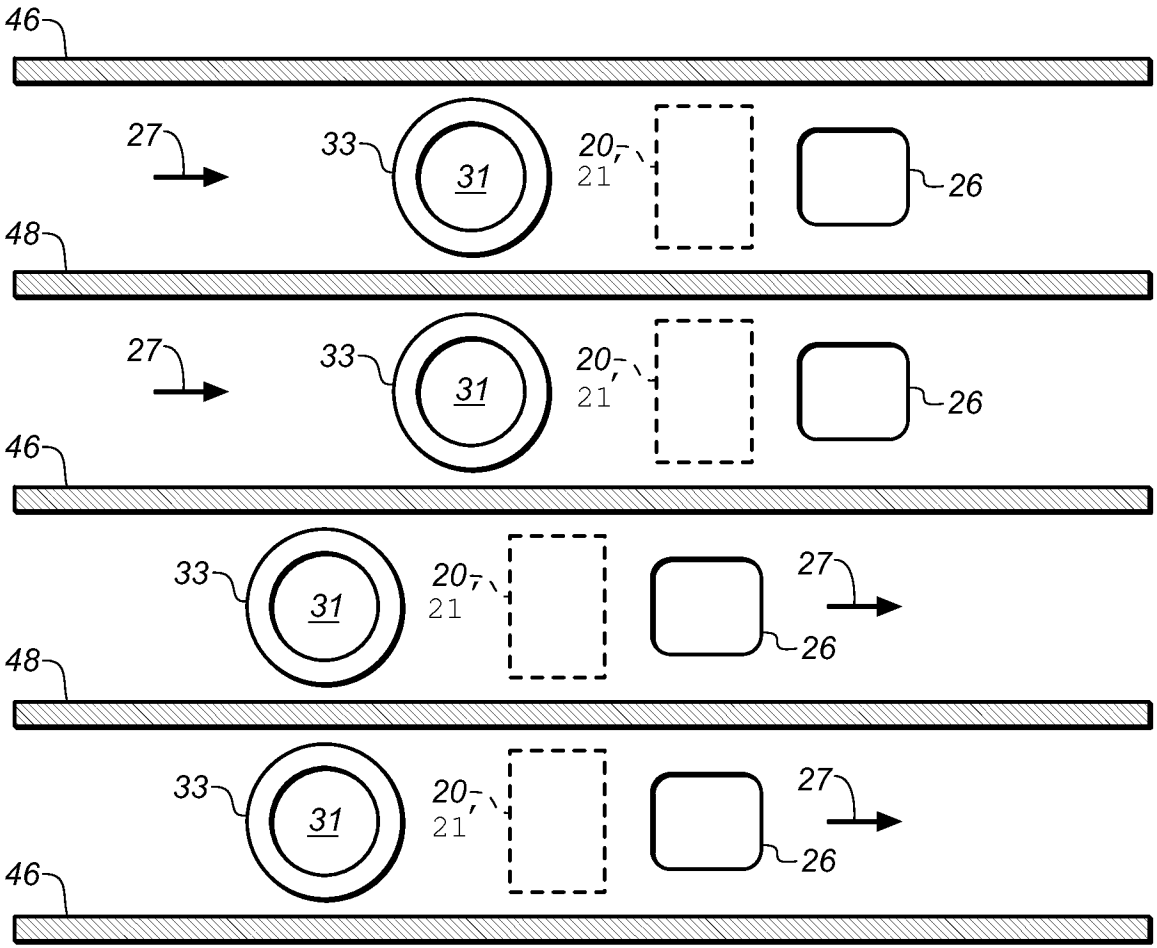
FIG. 6 is a schematic top view of another example embodiment of a liquid dispenser made in accordance with the present invention.

A linear array 42 of liquid dispensers 10 including the plurality of the liquid supply channels 31, the plurality of drop formation devices 33, the plurality of drop ejection devices 20, and the plurality of outlet openings 26 shown in FIG. 2. Also, the linear array 42 of liquid dispensers 10 is aligned perpendicular to the direction of the flow of the first liquid in the plurality of liquid dispensers in FIG. 2. In other example embodiments, the plurality of the liquid supply channels 31, the plurality of drop formation devices 33, the plurality of drop ejection devices 20, and the plurality of outlet openings 26 in the array of structures 40 are arranged in other patterns. For example, as shown in FIG. 5, linear array 42 of liquid dispensers 10 can be arranged in along a line at an angle to the shared centerline 58, 60 which is also the direction of the flow of the first liquid in the plurality of liquid dispensers. This arrangement allows creating a high resolution pattern along the array direction. Referring to FIG. 6, in other example embodiments, the liquid supply channels 31, drop formation devices 33, drop ejection devices 20, and outlet openings 26 of plurality of the liquid dispensers 10 can be grouped in two or more groups and arranged in linear arrays of the grouped structures separated in their location along the direction of the flow of the first liquid in the plurality of liquid dispensers.

Figure 3:
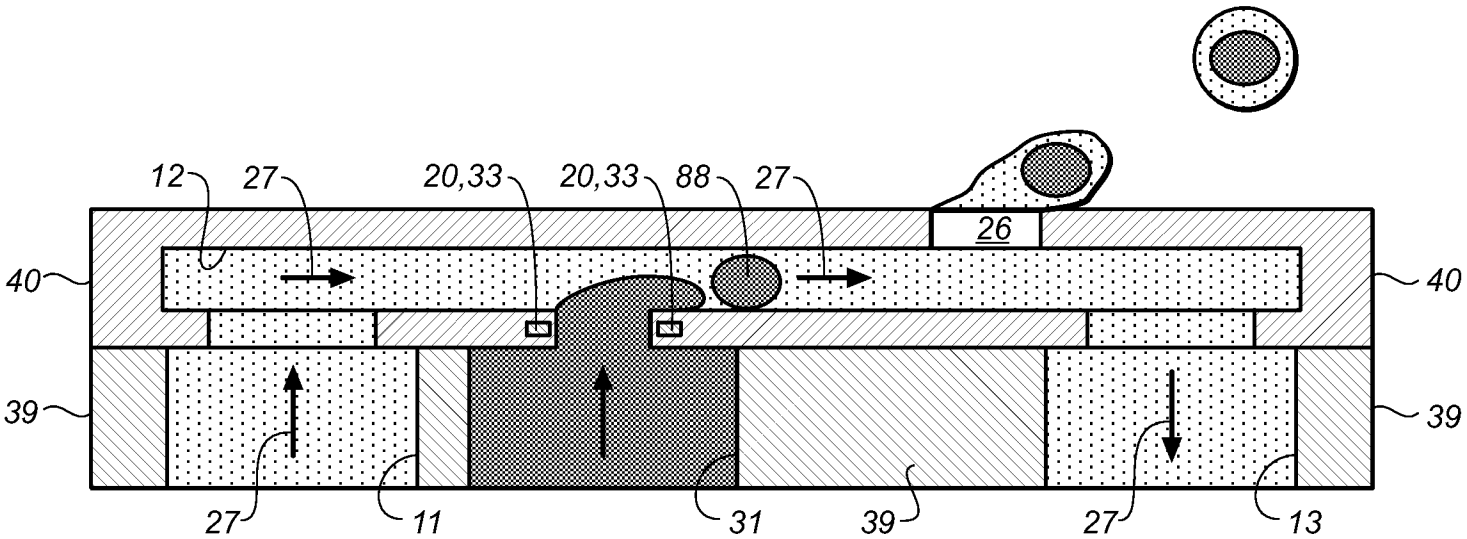
FIG. 3 is a schematic cross sectional view of another example embodiment of a liquid dispenser made in accordance with the present invention.

Referring to FIG. 3, another example embodiment of a liquid dispenser 10 made in accordance with the present invention is shown. In this embodiment, drop formation device 33 and drop ejection device 20 are the same device. The device, as shown, is a bubble jet type heater that vaporizes a portion of carrier liquid 25 in order to form a discrete drop of second liquid 84 flowing in carrier liquid 25 and divert a previously formed discrete drop toward outlet opening 26 of liquid dispensing channel 12.

Referring back to FIGS. 1 and 2, drop formation device 33 drop ejection device 20 are separate distinct mechanisms that are selectively actuated independently relative to the other mechanism. This allows selection of the mechanism to be at least partially tailored to the specific application contemplated so as to improve performance and reliability. For example, drop formation device 33 can include a bubble jet type heater that vaporizes a portion of the carrier liquid 25 flowing through liquid dispensing channel 12 to form a discrete drop of second liquid 84 in carrier liquid 25. Alternatively, drop formation device 33 can include a thermal actuator that modulates an interfacial surface tension between the carrier liquid and the functional liquid to form a discrete drop of second liquid 84 in carrier liquid 25 or drop formation device 33 can include a thermal actuator that modulates a viscosity of at least one of the carrier liquid and the functional liquid to form a discrete drop of second liquid 84 in carrier liquid 25. In FIGS. 1 and 2, drop formation device 33 is ring shaped positioned around the interface of liquid dispensing channel 12 and second liquid supply channel 31.

In some example embodiments of the present invention, drop formation device 33 includes a mechanical actuator that modulates a pressure across a meniscus between the carrier liquid and the functional liquid to form a discrete drop of second liquid 84 in carrier liquid 25. In other example embodiments, drop formation device 33 includes a pair of electrodes that modulate an interfacial surface tension between the carrier liquid and the functional liquid to form a discrete drop of second liquid 84 in carrier liquid 25.

Drop ejection device 20 can include a thermal actuator, for example, a heater, or can incorporate using heat in its actuation. As shown in FIGS. 1 and 2, drop ejection device 20 includes a heater that vaporizes a portion of the carrier liquid 25 flowing through liquid dispensing channel 12 so that another portion of the carrier liquid 25 and the discrete drop of second liquid 84 is diverted toward outlet opening 26. This type of heater is commonly referred to as a "bubble jet" heater. Alternatively, drop ejection device 20 can include a heater, for example, a bi-layer or tri-layer thermal microactuator, that is selectively movable into and out of liquid dispensing channel 12 during actuation to divert a portion of the liquid flowing through liquid dispensing channel 12 toward outlet opening 26. These types of actuators are known and have been described in at least one or more of the following commonly assigned US Patents: U.S. Pat. No. 6,464,341 B1; U.S. Pat. No. 6,588,884 B1; U.S. Pat. No. 6,598,960 B1; U.S. Pat. No. 6,721,020 B1; U.S. Pat. No. 6,817,702 B2; U.S. Pat. No. 7,073,890 B2; U.S. Pat. No. 6,869,169 B2; and U.S. Pat. No. 7,188,931 B2. In other example embodiments of the invention, drop ejection device 20 can be other types of mechanisms including, for example, a piezoelectric transducer. Generally, the carrier fluid is selected to be compatible to work with the above mentioned choices of the drop formation transducers 34 and drop ejection transducers 21.

Referring back to FIGS. 1-3, a liquid dispensing operation using liquid dispenser 10 will now be discussed. Liquid dispenser 10 is provided and includes a first liquid supply channel 11, a liquid dispensing channel 12, and a liquid return channel 13. Liquid dispensing channel 12, including an outlet opening 26, is in fluid communication with the first liquid supply channel 11. Liquid return channel 13 is in fluid communication with liquid dispensing channel 12. A second liquid supply channel 31 in fluid communication with liquid dispensing channel 12 at a location that is upstream relative to the location of outlet opening 26. A first liquid supply 24 is provided and is in fluid communication with first liquid supply channel 11. A second liquid supply 86 is provided and is in fluid communication with second liquid supply channel 31. A drop formation device 33 is provided and is associated with an interface of the second liquid supply channel 31 and the liquid dispensing channel 12. A drop ejection device 20 is provided and is associated with the liquid dispenser 10, for example, associated with the outlet opening 26, the liquid dispensing channel 12, or both the outlet opening 26, the liquid dispensing channel 12.

A carrier liquid 25 is provided under pressure using the first liquid supply 24. The carrier liquid 25 flows continuously from the first liquid supply 24 through the first liquid supply channel 11 through the liquid dispensing channel 12 through the liquid return channel 13 and back to the first liquid supply 24 during a liquid drop dispensing operation. A functional liquid 84 is provided to the liquid dispensing channel 12 through the second liquid supply channel 31 using the second liquid supply 86.

The drop formation device 33 is selectively actuated to form a discrete drop of the functional liquid 84 in the carrier liquid 25 flowing through the liquid dispensing channel 12. The functional liquid 84 is immiscible in the carrier liquid 25. The drop ejection device 20 is selectively actuated to divert the discrete drop of the functional liquid 84 and a portion of the carrier liquid 25 flowing through the liquid dispensing channel 12 toward the outlet opening 12 of the liquid dispensing channel 12. The primary motive energy for the creation of a drop 15 (and ejection of drop 15) is provided by the momentum of the carrier liquid 25 traveling though the liquid dispensing channel 12.

In example embodiments of the present invention, drop formation device 33 including one or more drop formation transducers 34 and the drop ejection device 20 including one or more drop ejecting transducers.

In example embodiments of the present invention in which the drop formation device 33 and the drop ejection device 20 are the same device, actuation of the device causes a discrete drop of the functional liquid 84 to form in the carrier liquid 25 flowing through the liquid dispensing channel 12 and diverts a previously formed discrete drop of functional liquid 84 formed in carrier liquid 25 toward the outlet opening 12 of the liquid dispensing channel 12. In example embodiments of the present invention in which the drop formation device 33 and the drop ejection device 20 are distinct devices, actuation of the devices occurs either simultaneously sequentially in order to form a discrete drop of the functional liquid 84 in the carrier liquid 25 flowing through the liquid dispensing channel 12 and divert a previously formed discrete drop of functional liquid 84 formed in carrier liquid 25 toward the outlet opening 12 of the liquid dispensing channel 12.

In the arrangements shown in FIGS. 1-3, the flowing carrier liquid 27 not only assists in metering and transporting drops 88 of liquid 84 drops but also prevents a direct contact of liquid 84 with surrounding air. This feature is very useful in improving reliability of liquid dispenser 10 by preventing drying of liquid 84 which is typically a more complex fluid than carrier liquid 27. Such drying is highly undesirable as it results in clogging of one or more regions of liquid supply channel, second liquid supply channel, liquid dispensing channel and outlet opening of the liquid dispenser. Similarly, the flowing carrier liquid 27 also acts as a lubricant and prevents a direct contact of the drops 88 of liquid 84 to walls liquid supply channel, second liquid supply channel, liquid dispensing channel and outlet opening of the liquid dispenser. This helps in avoiding adhesion of the drops 88 to walls which can also cause clogging the dispensing structure. Further, flowing carrier fluid 27 also enables printing with liquid 84 when it is unstable when exposed to atmosphere.

The invention has been described in detail with particular reference to certain preferred embodiments thereof, but it will be understood that variations and modifications can be effected within the scope of the invention.

PARTS LIST

10 liquid dispenser
11 liquid supply channel
12 liquid dispensing channel
13 liquid return channel
15 drop
16 regulated pressure supply source
17 regulated vacuum supply source
18 upstream edge
19 downstream edge
20 drop ejection device
21 drop ejection transducer
24 liquid supply
25 liquid
26 outlet opening
27 liquid flow direction/arrows
31 second liquid supply channel
33 drop formation device
34 drop formation transducer
35 second regulated pressure source
39 substrate
40 structure
42 array of liquid dispensers 10
46 wall
48 wall
50 upstream edge
52 downstream edge
54 surface
54A interior surface
54B exterior surface
55 central portion
56 corner
58 centerline
60 centerline
64 width
70 length
72 width
84 second liquid
86 second liquid supply
88 second liquid drops
90 meniscus between functional liquid and carrier liquid

The invention claimed is:

1. A method of dispensing liquid comprising:
providing a liquid dispenser including:
a first liquid supply channel;
a liquid dispensing channel including an outlet opening, the liquid dispensing channel being in fluid communication with the first liquid supply channel;
a liquid return channel in fluid communication with the liquid dispensing channel;
a second liquid supply channel in fluid communication with the liquid dispensing channel;
providing a first liquid supply;
providing a second liquid supply;
providing a drop formation device associated with an interface of the second liquid supply channel and the liquid dispensing channel;
providing a drop ejection device;
providing a carrier liquid under pressure using the first liquid supply, the carrier liquid flowing from the first liquid supply through the first liquid supply channel through the liquid dispensing channel through the liquid return channel and back to the first liquid supply continuously during a drop dispensing operation;
providing a functional liquid to the liquid dispensing channel through the second liquid supply channel using the second liquid supply;
selectively actuating the drop formation device to form a discrete drop of the functional liquid in the carrier liquid flowing through the liquid dispensing channel, the functional liquid being immiscible in the carrier liquid; and
selectively actuating the drop ejection device to divert the discrete drop of the functional liquid and a portion of the carrier liquid flowing through the liquid dispensing channel toward the outlet opening of the liquid dispensing channel.

2. The method of claim 1, wherein selectively actuating the drop formation device and selectively actuating the drop ejection device includes selectively actuating the same device.

3. The method of claim 1, wherein the drop formation device and the drop ejection device are actuated simultaneously.

4. The method of claim 1, wherein the drop formation device and the drop ejection device are actuated sequentially.

5. The method of claim 1, wherein selectively actuating the drop ejection device to divert the discrete drop of the functional liquid and a portion of the carrier liquid flowing through the liquid dispensing channel toward the outlet opening of the liquid dispensing channel encapsulating the discrete drop of the functional liquid with the carrier liquid.

* * * * *